United States Patent [19]

Stancliffe et al.

[11] Patent Number: 4,865,011

[45] Date of Patent: Sep. 12, 1989

[54] SOLID FUEL BURNING SPACE HEATING APPLIANCES

[75] Inventors: John N. Stancliffe, Allestree; Stephen Carnelly, Belper, both of England; Robert W. Ferguson, South Royalton; Derik K. Andors, Randolph, both of Vt.

[73] Assignees: Vermont Casings, Inc., Randolph, Vt.; TI Parkray Limited, Belper, United Kingdom

[21] Appl. No.: 62,910

[22] Filed: Jun. 16, 1987

[30] Foreign Application Priority Data

Jun. 20, 1986 [GB] United Kingdom ..... 8615153

[51] Int. Cl.[4] ..... F23M 7/00; F24C 15/04

[52] U.S. Cl. ..... 126/77; 126/193; 126/200

[58] Field of Search ..... 126/193, 198, 200, 77; 98/36; 239/601, DIG. 1, 597

[56] References Cited

U.S. PATENT DOCUMENTS

| | | | |
|---|---|---|---|
| 3,188,936 | 6/1965 | Nordstrom et al. | 98/36 |
| 3,190,207 | 6/1965 | Weisz | 98/36 |
| 3,287,551 | 6/1968 | Hughes | 98/36 X |
| 3,608,468 | 9/1971 | McClurkin | 98/36 |
| 3,645,191 | 2/1972 | Asker et al. | 98/36 |
| 3,726,204 | 4/1973 | Lindeström | 98/36 |
| 3,744,724 | 7/1973 | Caille | 98/36 X |
| 4,214,570 | 7/1980 | Hansmeyer | 126/121 |
| 4,404,953 | 9/1983 | Thulman et al. | 126/77 |
| 4,461,273 | 7/1984 | Barker et al. | 126/77 |
| 4,475,529 | 10/1984 | Milligan | 126/193 X |
| 4,487,195 | 12/1984 | Syme et al. | 126/77 |
| 4,683,868 | 8/1987 | Ferguson et al. | 126/193 |

FOREIGN PATENT DOCUMENTS

| | | | |
|---|---|---|---|
| 0040100 | 12/1981 | European Pat. Off. . | |
| 391357 | 12/1973 | U.S.S.R. | 98/36 |
| 2056052 | 3/1981 | United Kingdom . | |

*Primary Examiner*—Robert E. Garrett
*Assistant Examiner*—Carl D. Price
*Attorney, Agent, or Firm*—Wolf, Greenfield & Sacks

[57] ABSTRACT

A solid fuel burning space heating appliance comprises a combustion chamber including front, side and rear walls, a top and a bottom. An apertured grate arrangement is provided in the combustion chamber for supporting solid fuel. An ash collecting region is located under the grate arrangement, with an air inlet for providing combustion air. A first air outlet in the combustion chamber is located below the grate arrangement, and a second air outlet in the combustion chamber is located above the grate arrangement. An air diverting arrangement is provided for selectively diverting air from the air inlet between the first and second air outlets. A glass cleaning system provides a vertical curtain of air over the interior surface of a glass panel. The glass cleaning system includes an air supply adjacent one side wall, an air reservoir connected to the air supply and a dam defining a tapered outlet slot for providing the curtain of air from the air reservoir. A tangential-flow fan is located between the combustion chamber and an outer casing. An air duct extends from the front of the appliance to the ends of the fan for cooling purposes.

4 Claims, 5 Drawing Sheets

SOLID FUEL BURNING SPACE HEATING APPLIANCES

This invention relates to solid fuel burning space heating appliances and is especially, although not solely, applicable to so-called multifuel appliances i.e. those appliances which are intended to burn both mineral solid fuel e.g. coal and also wood.

Mineral solid fuels are normally burned in closed stoves in a firebox which provides a combination of undergrate combustion air (i.e. air which passes through holes or slots in the bottomgrate and thence through the firebed) and overgrate combustion air (i.e. air which is arranged to appear above the firebed without passing through it). As a general rule fuels with a low volatile hydrocarbons content burn best with a high proportion of undergrate air and very little overgrate air and those with a higher volatile hydrocarbons content require a higher proportion of overgrate air. Wood has a very high volatile hydrocarbons content and is typically burned with very little or no undergrate air, all or most of the combustion air being provided overgrate.

Mineral fuels, which typically have a much higher bulk density than wood, produce proportionally more ash than does wood, and it is therefore normal to provide means by which the ash produced during combustion may be removed from the firebox. A system generally employed is to arrange for the ash to fall through the undergrate air slots into an ashpan aided by mechanical agitation of the firebed. Since the volume of ash produced during woodburning is less and because the combustion method does not necessarily require undergrate air, wood may be burned on a solid impervious bottomgrate with no automatic ash removal means; indeed it is generally agreed that wood combustion is improved by having a bed of hot ash beneath the burning logs.

Multifuel appliances are sometimes provided with means to convert both the bottomgrate and combustion air distribution system to suit the combustion characteristics of the fuel to be burned. In some cases the conversion involves removal of some firebox components for replacement by others and in other cases the actual firegrate configuration is changed by mechanical means to change it from having large holes or slots to having small or no holes or slots. In most instances the conversion is difficult or impossible whilst a fire is burning in the appliance.

It is an object of the present invention to provide a solid fuel burning appliance which is more readily adapted for multifuel operation.

In accordance with a first aspect of the present invention there is provided a solid fuel burning space heating appliance comprising a combustion chamber including front, side and rear walls, a top and a bottom, an apertured grate arrangement in said combustion chamber for supporting solid fuel to be burnt in said appliance, an ash collecting region under said grate arrangement, air inlet means for providing air for combustion in said chamber, first air outlet means in said combustion chamber located below said grate arrangement and second air outlet means in said combustion chamber located above said grate arrangement, air diverting means being provided for selectively diverting air from said inlet means between said first and second outlets.

In operation of said appliance, said diverting means may be arranged to divert air from said inlet means either totally to the first air outlet, totally to the second air outlet or adjustably proportioned between the two outlets to suit the combustion requirements of mineral fuels or wood.

Solid fuel burning space heating appliances meant for domestic use are appealing because they provide a focal point to the room in which they are installed, and a view of the fuel burning. Open fires are particularly attractive in this way but are not very efficient. Closed stoves with glass doors are much more efficient in operation, but when burning fuels having high volatile hydrocarbon levels such as wood, condensation of the volatiles on the glass can occur such that the view of the fire is obscured. In some appliances intended to burn wood using overgrate combustion air, the air entrance to the combustion chamber is positioned adjacent to the inside upper or lower surface of the glass to produce an air wash intended to prevent condensation on the glass. Such systems are known to operate reasonably. effectively at high combustion rates when the volume of combustion air passing across the inside surface of the glass is high but are not particularly satisfactory at low combustion rates.

An air wash system has also been suggested which improves laminar air flow over the inside surface of the glass at low combustion rates, which has extended and enhanced clean glass wood burning technology. However, this system relies upon combustion air symmetrically entering a large air reservoir before distribution via a dam and distribution plate over the glass, and is not particularly appropriate to multifuel appliances.

It is therefore a further object of the present invention to provide a solid fuel burning space heating appliance having a glass viewing panel and an improved air wash system for maintaining the glass panel clean.

According to a second aspect of the present invention there is provided a solid fuel burning space heating appliance comprising a combustion chamber including front, side and rear walls, a top and a bottom, a transparent glass panel mounted in said front wall to permit viewing of combustion in the combustion chamber, and glass panel cleaning means for supplying a curtain of air flowing substantially uniformly in a vertical direction over the interior surface of said transparent glass panel, said curtain of air being derived from air supply means located adjacent one side wall only of said appliance, said cleaning means having means for producing said curtain which varies over the width of said curtain to determine the uniformity thereof.

In carrying out the invention according to the aforesaid second aspect, the means for supplying said curtain may comprise an air reservoir located preferably above but possibly below, the transparent glass panel, the air reservoir being supplied with air at one end only thereof, the air reservoir having a dam arrangement for affording said curtain of air, the dam arrangement having an output slot which varies over the width of said curtain to determine the uniformity thereof.

Advantageously, the output slot will be widest at the end nearest the end of the air reservoir to which air is supplied and narrowest at the other end.

In order to further improve the uniformity of said curtain, air deflection means may be provided having an edge spaced from the transparent glass panel across the width thereof, said spacing varying across the width of said panel, the curtain of air being caused to pass between said edge and said panel.

Solid fuel burning space heating appliances may be of the stand-alone or surface mounting type in which case they consist essentially of a simple combustion chamber, or they may be of the inset type designed to be inset in, say, a fireplace opening, in which case they usually consist of a combustion chamber contained within an outer casing. The outer casing is normally larger than the combustion chamber to allow for the circulation of air around the combustion chamber, this air being heated by the combustion chamber and emitted by the appliance as a source of convection air.

Many woodburning and multifuel inset appliances sold in continental Europe have convection assistance fans of the cylindrical rotor type. In most instances the fan or fans are located at the front of the appliance, this being possible because either no or a very small ash collection pan is provided. U.K. approval requirements dictate that a relatively large ash collection pan which effectively covers the whole of the bottomgrate area of the fire is provided. Incorporation of such an ashpan into an appliance makes it difficult to arrange location of the fan in an aesthetically and technically acceptable position in front of the ashpit cover.

It is therefore a further object of the present invention to provide a solid fuel burning space heating appliance of inset form and having an improved form of convection assistance fan.

According to a third aspect of the present invention there is provided a solid fuel burning space heating appliance comprising a combustion chamber including, front, side and rear walls, a top and a bottom, an outer casing in which the combustion chamber is located, the outer casing being spaced from the combustion chamber to permit air to circulate between them, a tangential flow type fan disposed in the bottom of said outer casing between the combustion chamber and the outer casing, the axis of said fan being substantially parallel to the rear wall of said casing, and air ducting means extending from a cool air inlet at the front of said appliance to the opposed ends of said fan, it being arranged that in use of the fan, cool air is caused to flow through said ducting to the ends of said fan for cooling purposes.

In carrying out the invention according to the aforesaid third aspect, each end of said fan will be provided with a respective air duct which extends from the front of said appliance and which extends over the respective end of said fan, and preferably over part of the fan rotor also, the air ducts being disposed relative to said fan such that operation of said fan causes cooling air to flow in said ducts.

In this way the convection assistance fan is provided within the appliance this being possible due to the cooling that is provided, and so does not interfere with the ashpit requirements of the appliance.

In the United Kingdom, fireplaces are currently manufactured to a standard design and therefore connections between an appliance and the fireplace flue are reasonably standardised. This is not the case in continental Europe. It is therefore yet a further object of the present invention to provide a flue connector device of relatively universal application.

In accordance with a fourth aspect of the present invention there is provided a flue connector device comprising two parts which are rotatively connected together, each part being of tubular form and each having end faces which are angularly displaced relative to one another, each end face having a circular hole therein, one end face of one of said parts being rotatably connected to one end face of the other of said parts whereby the angular displacement between the other faces of said parts may be varied.

In one preferred embodiment the angular displacement between the faces of each part will be 22½° whereby the angular displacement between said other faces of said parts may be varied between 0° and 45°, and in another preferred embodiment the angular displacement between the faces of each part will be 45° whereby the angular displacement between said other faces of said parts may be varied between 0° and 90°.

Some exemplary embodiments of the invention will now be described, reference being made to the accompanying drawings, in which.

Figure 1:
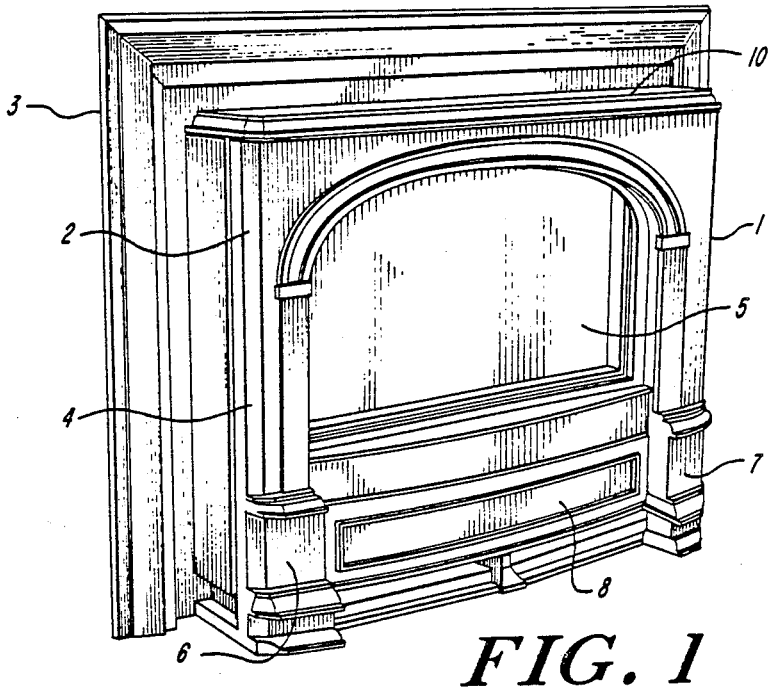
FIG. 1, is a front perspective view of a solid fuel burning space heating appliance in accordance with the present invention, of inset form, and shown inset in a fireplace opening.

In FIG. 1 of the drawings there is shown a solid fuel burning space heating appliance 1 of the inset type, which comprises a front portion 2 which extends forward of an integral surround 3 and a rear portion (not shown) which is inset in a fireplace opening (not shown). The front portion 2 of the appliance includes a single sideways opening door 4, having a transparent glass panel 5 in it whereby combustion in the appliance can be viewed, the panel 5 preferably being of double glazed form. The appliance is also provided with two small sideways opening doors 6 and 7 in the bottom left and right corners respectively of the front portion 2, these affording access to various appliance controls e.g. thermostat, grate agitator etc., that are provided in the respective compartments behind the doors 6 and 7. The appliance 1 is also provided with an air inlet grill 9 by means of which convection air to the appliance is admitted.

Although not shown in FIG. 1, the appliance 1 being of inset form comprises an outer casing located behind the front part 2 of the appliance 1, the outer casing 2 normally being installed as a separate entity in a fireplace opening, before the remainder of the appliance is fitted. Within the outer casing is disposed a combustion chamber (not shown) arranged such that the air admitted via the air inlet grill 9 can be circulated between the outer casing and the combustion chamber to thereby be heated and output at the top of the appliance via output grill 10. A general form of the outer casing of the appliance 1 is shown in FIG. 6 and various parts of the combustion chamber of the appliance 1 are shown in FIGS. 2 to 5.

In order to provide that the solid fuel burning appliance described with reference to FIG. 1 has a multifuel capability, i.e. capable of burning mineral solid fuel or wood, it is arranged that the combustion chamber thereof be provided with a mechanical two-way air distribution system for directing input combustion air either to an undergrate outlet, to an overgrate outlet or proportionally between the two outlets.

Figure 2:
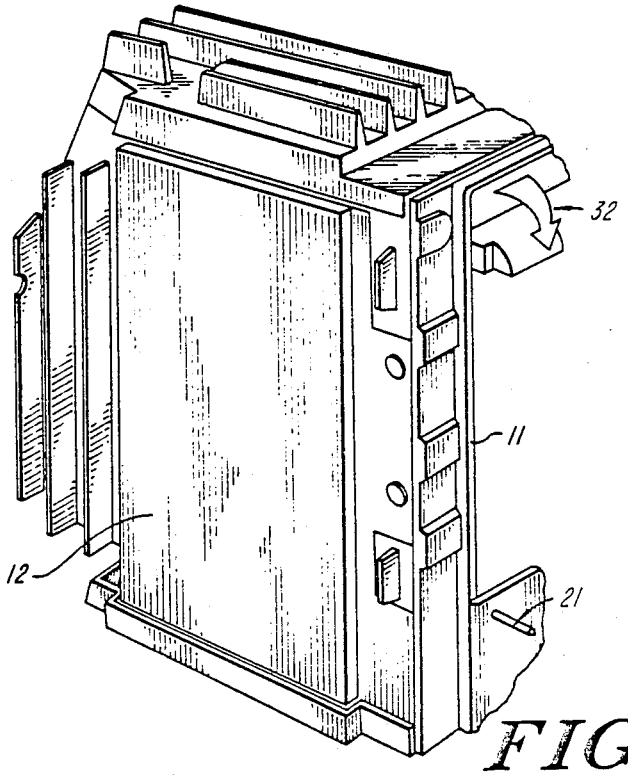
FIG. 2, is a perspective view of the left side of the combustion chamber of the appliance of FIG. 1.

In FIG. 2 of the drawings there is depicted an exterior view of the left side of a combustion chamber 11 having this facility, the mechanical two-way air distribution system being provided behind an air duct cover plate 12 attached to the side of the combustion chamber 11.

Figure 3:
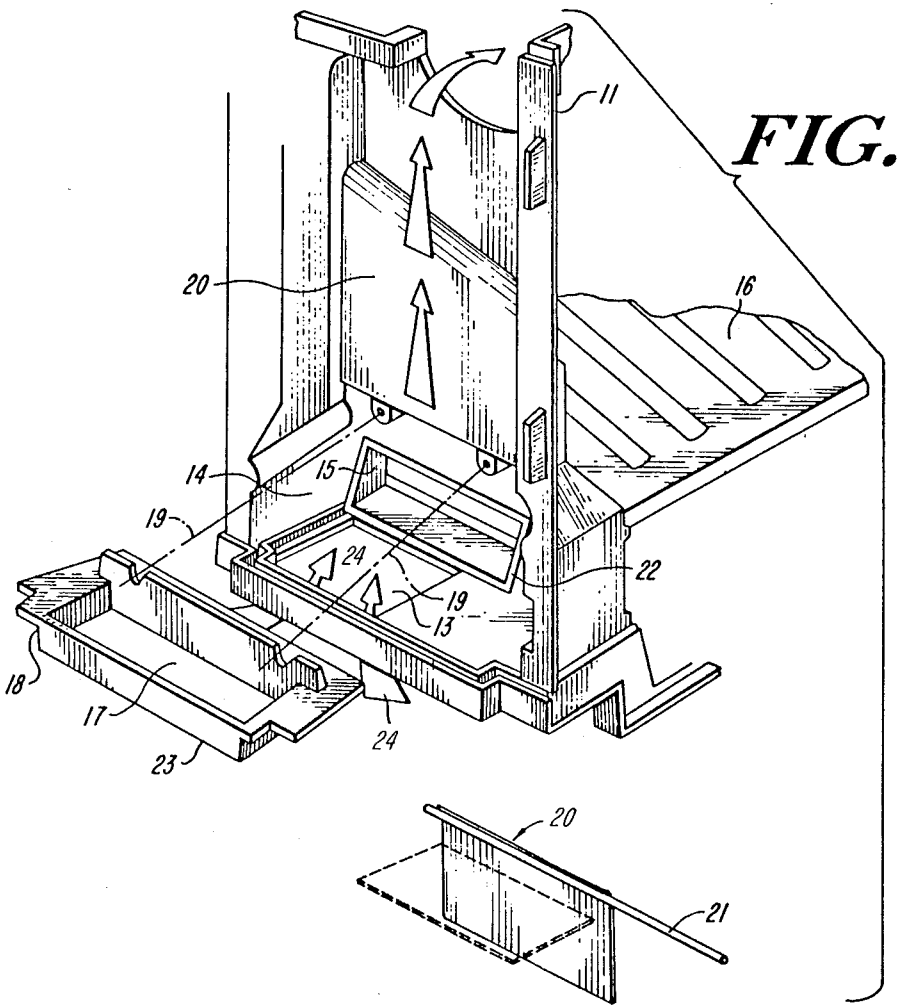
FIG. 3, is a view similar to that of FIG. 2 with the side coverplate removed.

In FIG. 3 of the drawings, there is shown a similar view of the combustion chamber 11 with the air duct cover plate 12 removed, and in FIG. 4 there is shown an inside view of the left side of the combustion chamber showing the air outlets to which reference will hereinafter be made.

In FIG. 3 an air inlet 13 is provided in the underside of the chamber 11 through which combustion air enters, conveniently via a thermostatic control as indicated by arrows 24, into a chamber 14. The chamber 14 is provided with two outlets, and outlet 15 which communicates with the interior of the combustion chamber 11 at a position below a grate arrangement therein indicated diagrammatically at 16 in FIG. 3, and a second outlet 17 in an air distribution sealing flange 18, which for convenience in FIG. 3 is shown separate from the chamber 11 but which in practice is bolted into place as indicated by the dashed lines 19, the outlet 18 extending upwards and into the interior of the combustion chamber 11 at a position above the grate arrangement 16.

In order to control the flow of air between the air outlets 15 and 17, an air control flap 20 having an air control spindle 21 is provided, which for convenience is shown separate in FIG. 3 but which in practice is pivotally mounted in the combustion chamber 11 such that the air control spindle 21 extends through the front as shown in FIG. 2, and the air control flap 20 is movable between a position in which it seats on surface 22 at the entrance to outlet 15 and a position in which it seats on surface 23 at the entrance to outlet 17. Therefore by suitably rotating the air control spindle 21, which, for example would be located in the compartment behind the control door 6 of the appliance of FIG. 1, air from the air inlet 13 can be diverted either totally under the grate arrangement 16 as indicated by arrow 25 in FIG. 4, via the outlet 15, or totally over the grate arrangement 16 as indicated by arrow 26 in FIG. 4, via the outlet 17 or it may be adjustably proportioned between the two to suit the combustion requirements of mineral fuels or wood. The adjustments may be made without the need for any fire in the combustion chamber being out, and the grate arrangement 16 may be provided with a mechanical de-ashing facility of a known type if required.

In known types of solid fuel burning space heating appliances it is known to be desirable to provide a curtain of air that is moved vertically across the transparent glass viewing panel in the front thereof, for the purpose of keeping the panel clean. In such known arrangements the curtain of air is derived symmetrically from both sides of the appliance. However, in the appliance this far described, the overgrate combustion air is supplied only via the outlet 17 and it is not practicable to provide a similar arrangement on the other side of the combustion chamber 11 in order to achieve a symmetrical supply of combustion air. A panel cleaning arrangement is therefore required operating from a non-symmetrical supply of combustion air for producing a curtain of air that is moved across the viewing panel in order to keep it clean.

Figure 5:
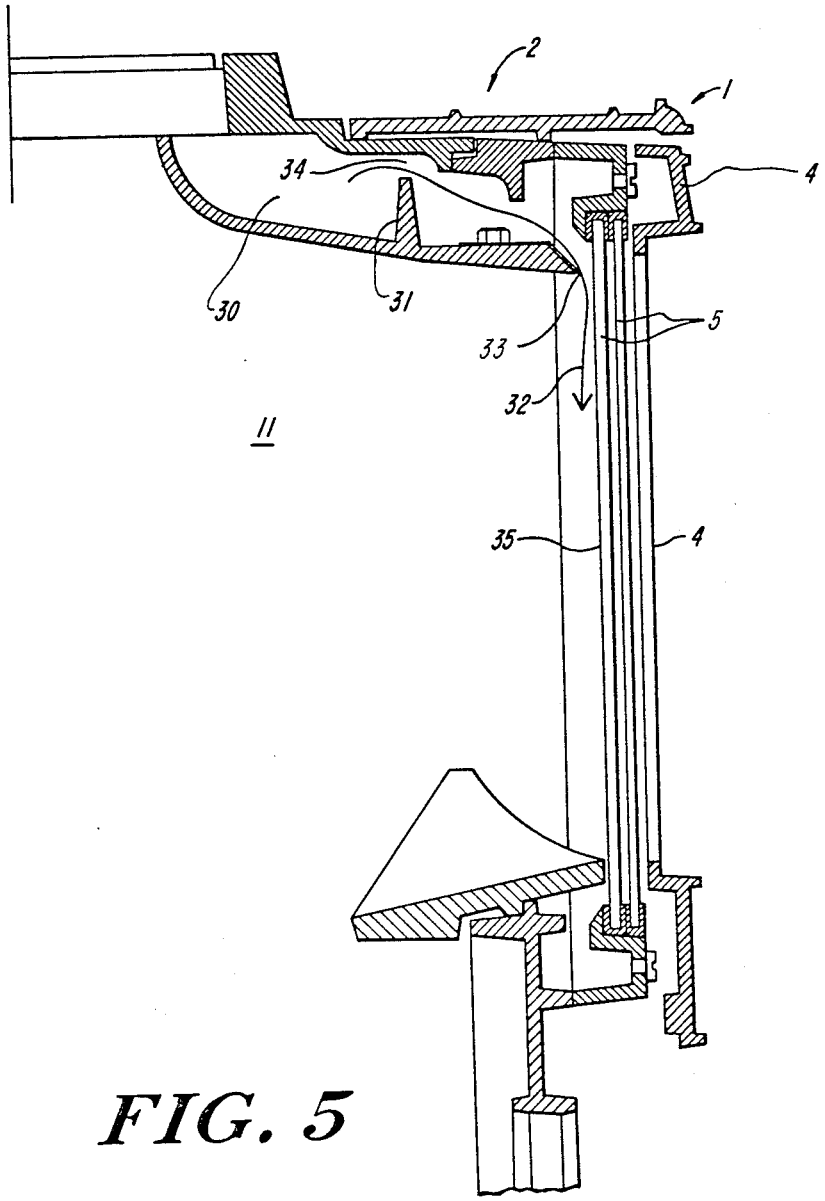
FIG. 5, is a cross-sectional view through the front upper part of the appliance of FIG. 1.
Figure 6:
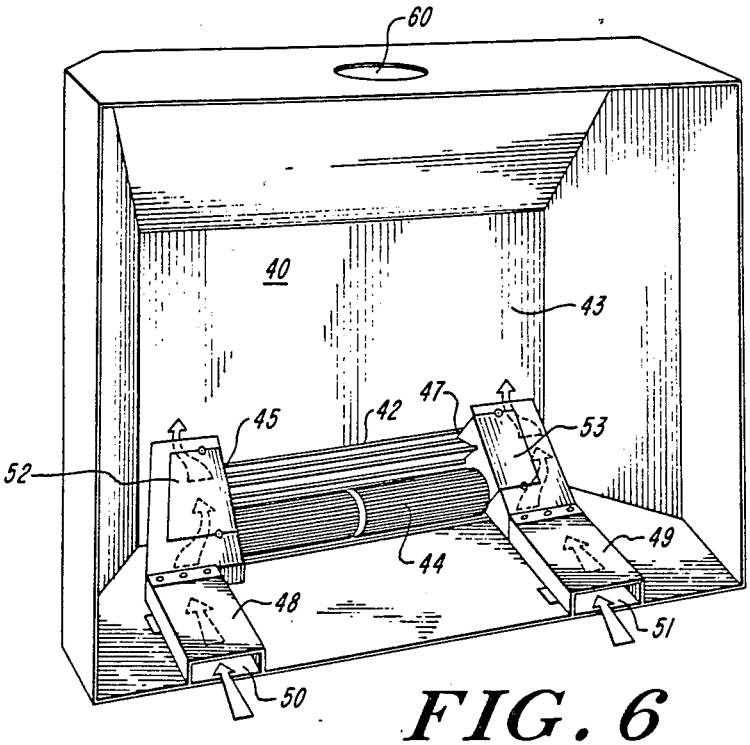
FIG. 6, is a perspective view of the inside of the outer casing of the appliance of FIG. 1.

Such an arrangement is depicted in FIG. 5 of the drawings, which is a cross-sectional view of the top part of the front portion 2 of the appliance 1 of FIG. 1.

Figure 4:
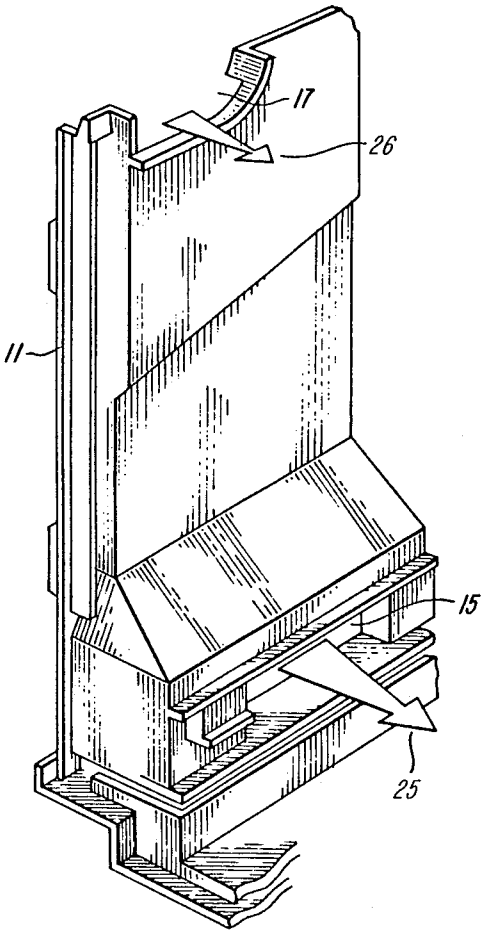
FIG. 4, is an inside view of the left side of the combustion chamber.

The panel cleaning arrangement shown in FIG. 5 comprises an air reservoir 30 which extends across the top of the combustion chamber 11 and which is supplied with heated air from the outlet 17, (FIG. 3) already described in relation to the arrangements of FIGS. 2 to 4. The air reservoir 30 is provided along its length with an upstanding dam 31 over which the air admitted to the air reservoir 30 is caused to flow in order to provide a curtain of air 32 which flows via an adjustable air distribution plate 33 the purpose of which will be described hereinafter, vertically downwards across the inside of the transparent glass panel 5 in the door 4 of the appliance 1.

Because the air supplied to the air reservoir 30 enters from one end only, there is a natural tendency, due to the velocity of the air, for it to collect at the other end of the reservoir 30, with the result that the curtain of air 32 would tend to be non-uniform along its width. In order to counteract this non-uniformity, it is arranged that the dam 31 is tapered along its length, it being lowest at the air inlet end of the reservoir 30 and highest at the other end of the reservoir 30, thereby providing a tapered output slot 34 above the dam 31, the slot 34 being widest at the air inlet end of the reservoir 30 and narrower at the other end of the reservoir 30. In a typical arrangement it has been found that an output slot 34 tapering from 11 mm at its widest point to 6 mm at its narrowest point is suitable.

For convenience the line of the top of the dam 31 is made straight but it should be appreciated that if the tendency for the air to unevenly distribute itself over the top of the dam 31 by virtue of its velocity parallel to the dam is to be totally nullified either a convex or concave form for the top of the dam may be better, and indeed an adjustable shape may be even better to take account of variable air velocity under varying combustion air requirements of the appliance.

In order to further improve the uniformity of the air curtain 32 as it flows over the inside surface 35 of the transparent glass panel 5, it is caused to pass over the adjustable air distribution plate 33 which is arranged at an angle of approximately 45° relative to the surface 35 of the panel 5 and which is also variable spaced from the inside surface 35, i.e. its spacing from the surface 35 is widest at the air inlet end of the reservoir 30 and narrower at the other end. Typically the spacing may be 14 mm at the nearest end and 3 mm at the other end.

Use of the air reservoir 30 in conjunction with the dam 31 and also the air deflection plate 33 in conjunction with the inside surface 35 of the glass panel 35 enables a substantially uniform curtain of air 32 to be diverted downwards across the inside surface 35 of the panel 5 of panel cleaning purposes to be obtained, notwithstanding that the air supply to the arrangement is supplied from one side only of the appliance.

Although in the arrangement of FIG. 5, the air reservoir 30 has been provided above the transparent glass panel 5, it should be appreciated that a similar reservoir arrangement may instead be provided below the panel 5 for directing a curtain of air vertically upwards across the inside surface 35 of the panel 5. In such an arrangement the air supplied to the reservoir is unlikely to be preheated.

As has already been mentioned, in inset appliances of the type depicted in FIG. 1, it is desirable to provide a convection assistance fan for increasing the flow of hot convected air. Up to the present time it has not been the practice to locate such a fan within the appliance itself due to the fact that the very high temperatures that exist in the fire result in any such fans having only a very short life-span.

However, it has been found that if a tangential-flow type of fan is used and if means is provided for ensuring that the ends of the fan which normally house the fan bearings and motor winding, are kept cool, then it is possible to locate the fan in the appliance.

In FIG. 6 of the drawings there is shown a perspective view of the inside of an outer casing 40 of the type that would be used in the appliance of FIG. 1, it being appreciated that within the outer casing 1 would be located the actual combustion chamber (not shown) of the appliance, the arrangement being such that an air space is provided between the combustion chamber and the outer casing in which convection air is circulated.

Figure 7:
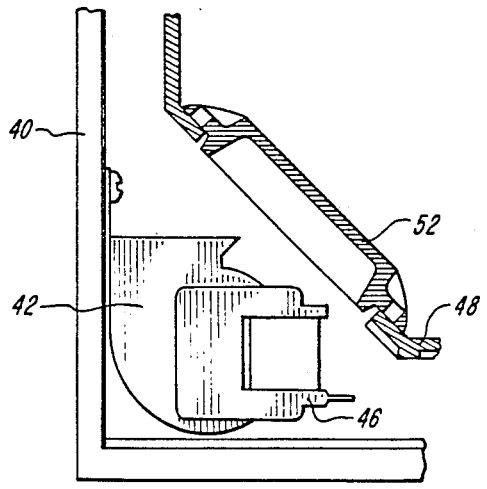
FIG. 7, is a cross-sectional view of the rear bottom section of the outer casing of FIG. 6 depicting the position of the convection assistance fan.

In FIGS. 6 and 7, a tangential-flow type fan 42 is shown located in the rear bottom corner of the outer casing 40, the axis of the fan 42 being substantially parallel to the rear wall 43 of the outer casing 40. The fan 40 comprises a cylindrical, tangential-flow type rotor 44, which is driven at one end 45 by a motor winding 46, (FIG. 7) and is supported at the other end 47 by a fan bearing (not shown). In order to ensure that the ends 45 and 47 of the fan 42 are kept cool, they are provided with respective air ducts 48 and 49 which preferably extend partly over the fan rotor, and which, due to the operation of the fan, conduct ambient air from respective air inlets 50, 51 at the front of the outer casing 40, over the ends 45 and 47 of the fan thereby keeping them cool. It will be appreciated that without the air ducts 48, 49, very little air would be caused to flow in the vicinity of the ends 45, 47 of the fan, the main air flow being determined by the fan rotor such that it would bypass the ends 45, 47 of the fan.

In order to provide access to the fan, the air ducts 48, 49 are provided with respective removable access plates 52, 53, and also, in order to avoid the combustion chamber of the appliance of FIG. 1 having to be dismantled to gain access to the fan 42, it may be arranged that the rear bottom corner of the combustion chamber be provided with a removable panel, by means of which access to the fan 42 may be obtained.

Figure 8:
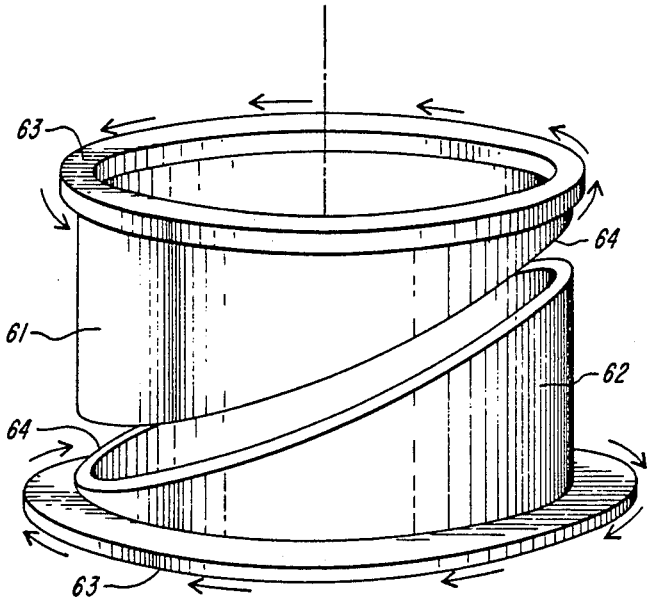
FIGS. 8 and 9, are side views of a flue connector device in accordance with the present invention suitable for use with the appliance of FIG. 1.
Figure 9:
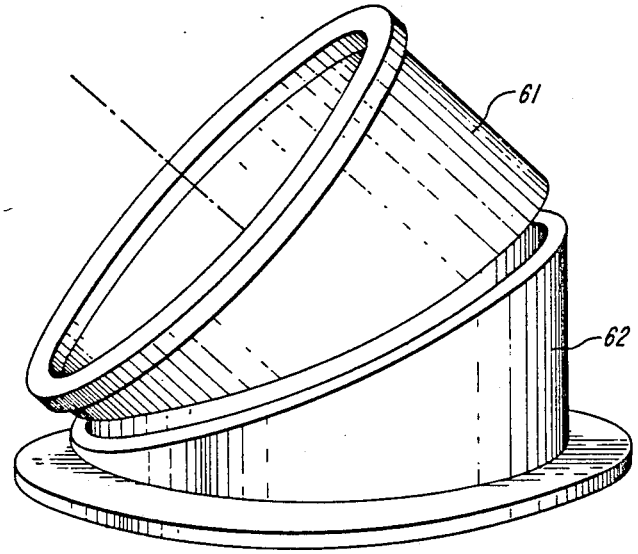

The outer casing depicted in FIG. 6 of the drawings is provided with a flue outlet 60 which during installation of the appliance is required to be coupled to a chimney flue pipe. In FIGS. 8 and 9 of the drawings there is depicted a flue connector device which is designed to have relatively universal application and which may be fitted over the flue outlet 60 in order to provide a connection to a chimney flue (not shown).

The flue connector device shown in FIGS. 8 and 9 comprises two parts 61 and 62 which are rotatively connected together by means of a suitable coupling (not shown). Each of the parts 61, 62 is of tubular form and each has end faces 63, 64 which are each of circular cross-section, the faces 63, 64 being angularly displaced relative to one another. Typically the angular displacement may be 22½°.

By selectively contra-rotating the parts 61, 62 the angular displacement between faces 63 of the two parts may be varied between 0° as depicted in FIG. 8 of the drawings, to 45° as depicted in FIG. 9 of the drawings, or any angular displacement therebetween.

It will be appreciated that the angular displacement between the end faces 63, 64 of each of the parts 61, 62 need not be 22½° but could be of any convenient angle. For example an angular displacement of 45° between the faces affords an overall angular displacement that can be varied between 0° and 90°.

In solid fuel appliances of the type hereinbefore described, it is sometimes required to limit the combustion rate so as to reduce the maximum output from the appliance. In the past this has been achieved by using a sheet steel insert which is used to restrict the size of combustion air inlet. Whilst such an arrangement does have the effect of reducing the maximum output it also has the disadvantageous affect of reducing the amount of combustion air that is available during start-up when the appliance is cold, thereby making start-up more difficult.

In appliances of the type hereinbefore described, it is known to use a hydraulic thermostat for controlling the heat output of the appliance, the thermostat having a sensing phial associated with it which is used to sense the heat output of the appliance. Typically the phial may be positioned on the front casting of the firebed of the appliance and offset from the centre of the appliance dependent upon the actual maximum heat output required. It has now been appreciated that in order to reduce the maximum heat output of the appliance it is only necessary to move the phial to a position which is relatively hotter than its usual position, e.g. nearer to the centre of the appliance. Thus by providing an appliance with alternative phial positions, HIGH/LOW maximum output options may be achieved on a single appliance.

It will be appreciated that although the foregoing embodiments have been described in relation to a solid fuel burning space heater of inset type capable of multifuel operation, various features may have wider application. For example, the air ducting arrangement of FIGS. 2 to 4 may be applicable to single solid fuel e.g. mineral solid fuel or wood, appliances; the air cleaning arrangement of FIG. 5 may be applicable to single solid fuel appliances; the fan arrangement of FIGS. 6 and 7 may be applicable to standalone or surface mounted appliances as well as inset appliances; and the flue connector device of FIGS. 8 and 7 may have application in any fuel burning appliance.

We claim:

1. A solid fuel burning space heating appliance comprising a combustion chamber including front, side and rear walls, a top and a bottom, a transparent glass panel mounted in said front wall to permit viewing of combustion in the combustion chamber, and glass panel cleaning means for supplying a curtain of air flowing substantially uniformly in a vertical direction over an interior surface of said transparent glass panel, said curtain of air being derived from air supply means located adjacent one side wall only of said appliance, said cleaning means including an air reservoir supplied with air from said air supply means at one end only, a dam arrangement in said air reservoir, the dam arrangement defining a linear, horizontal slot which varies in width to control the uniformity of said curtain of air, and air deflection means spaced from the transparent glass panel by a spacing that varies across said panel, the curtain of air being caused to pass between said air deflection means and said panel.

2. An appliance as claimed in claim 1, in which the output slot tapers from widest at a first end nearest the end of the air reservoir to which air is supplied to narrowest at a second end.

3. An appliance as claimed in claim 1, in which the air reservoir is disposed above the transparent glass panel.

4. A solid fuel burning space heating appliance comprising:

a frame assembly enclosing a combustion chamber, said frame assembly including front, side and rear walls, a top and a bottom;

a transparent glass panel mounted in said front wall to permit viewing of combustion in the combustion chamber, said glass panel having an interior surface facing said combustion chamber; and glass panel cleaning means for supplying a curtain of air flowing substantially uniformly in a vertical direction over the interior surface of said transparent glass panel, said glass panel cleaning means including an air reservoir elongated in a horizontal direction parallel to said glass panel, air supply means for supplying air to only one end of said air reservoir, a dam defining a horizontal slot in said air reservoir, said horizontal slot being tapered from widest at an end closest to said air supply means to narrowest at the other end, and an air distribution plate located between said horizontal slot and said glass panel and spaced from said glass panel by a spacing that varies across said panel, said spacing being varied from widest at an end closest to said air supply means to narrowest at the other end.

* * * * *